US006446611B2

(12) United States Patent
Ishikawa

(10) Patent No.: US 6,446,611 B2
(45) Date of Patent: Sep. 10, 2002

(54) PULSATION TYPE DIAPHRAGM PUMP

(75) Inventor: Norikazu Ishikawa, Atsugi (JP)

(73) Assignee: Nippon Carburetor Co., Ltd. (Kabushikikaisha Nihon Kikaki Seisakusho), Kanagawa (JP)

( * ) Notice: Subject to any disclaimer, the term of this patent is extended or adjusted under 35 U.S.C. 154(b) by 0 days.

(21) Appl. No.: 09/789,760

(22) Filed: Feb. 22, 2001

(30) Foreign Application Priority Data

Mar. 6, 2000 (JP) ..... 2000-060023
Mar. 6, 2000 (JP) ..... 2000-060024

(51) Int. Cl.[7] ..... F02M 37/04
(52) U.S. Cl. ..... 123/509; 417/395; 123/DIG. 5
(58) Field of Search ..... 123/509, DIG. 5; 417/395, 479, 480, 44.9, 413.1; 92/96, 98 R, 103 R, 103 F, 103 SD

(56) References Cited

U.S. PATENT DOCUMENTS 2,764,097 A * 9/1956 Brwone ..... 92/103 R
6,173,959 B1 * 1/2001 Oikawa et al. ..... 277/312
6,340,294 B1 * 1/2002 Kubota et al. ..... 417/395

FOREIGN PATENT DOCUMENTS

JP 47-34724 9/1972
JP 47-36322 9/1972
JP 50-83622 7/1975
JP 56-118546 9/1981
JP 02-112660 4/1990
JP 3-151561 6/1991
JP 5-280439 10/1993
JP 09-217662 8/1997
JP 11-173232 6/1999

* cited by examiner

*Primary Examiner*—Willis R. Wolfe
*Assistant Examiner*—Mahmoud Gimie
(74) *Attorney, Agent, or Firm*—Nath&Associates PLLC; Harold L. Novick; Marvin C. Berkowitz

(57) ABSTRACT

A pulsation type diaphragm pump prevents back flow of a fuel and has reduced parts and assembly requirements. An intake valve disposed between an intake chamber and a pump chamber has an intake valve seat protruded to an inner portion of the pump chamber and an intake valve body formed by a portion of a pump diaphragm. The intake valve body opens and closes an intake valve seat port in cooperation with an intake seat surface in accordance with oscillation of the pump diaphragm. A discharge valve disposed between the pump chamber and a discharge chamber has a discharge valve seat protruded to an inner portion of the discharge chamber and a discharge valve body formed by a portion of a pulsator diaphragm. The discharge valve body opens and closes a discharge valve seat port in cooperation with a discharge seat surface in accordance with oscillation of the pulsator diaphragm.

14 Claims, 6 Drawing Sheets

PULSATION TYPE DIAPHRAGM PUMP

BACKGROUND OF THE INVENTION

1. Field of the Invention

The present invention relates to a pump for supplying a fuel to a two cycle engine or a four cycle internal combustion engine, in general, to the two cycle engine, and more particularly to a pulsation type diaphragm pump which is driven by a pressure pulsation generated within a crank case or within an intake manifold in accordance with an operation of the engine.

2. Description of the Conventional Art

A mixture at a predetermined rate of air and fuel produced by a carburetor placed in an intake passage extending to a combustion chamber of the engine from an air cleaner is supplied to a two cycle or four cycle compact internal combustion engine as a power source for a farm machine, an outboard motor, a light car or the like. As a pump for feeding a fuel in a fuel tank to the carburetor, there is widely used a pulsation type diaphragm pump having advantages such as a simple structure in comparison with a mechanical or electromagnetic pump and a characteristic of being driven with no mechanical loss.

An embodiment of an arrangement among the air cleaner, the carburetor, the two cycle engine and the pulsation type diaphragm pump is described in Japanese Utility Model Publication No. 97317/1977. Further, a detailed explanation of the pulsation type diaphragm pump is described in pages 36 to 40 of a bimonthly "Car Technology" issued by Tetsudo-Nihon-Sha, Tokyo, Japan on January 1983.

FIG. 7 is a vertical cross sectional view showing the same structure as a typical pulsation type diaphragm pump described in the above bimonthly. A pump diaphragm 52 and a cover body 53 are laid over one surface of a main body 51 of the pump, and a recess provided in the main body 51 and covered by the pump diaphragm 52 forms a pump chamber 54. An inner portion of the cover body 53 partitioned from the pump chamber 54 by the pump diaphragm 52 forms a pulse chamber 55, and a diaphragm spring 57 is received in the pulse chamber 55.

A pulsator diaphragm 58 and a cap 59 are laid over another surface of the main body 51, and two recesses provided in the main body 51 to be back to back with the first mentioned recess and covered by the pulsator diaphragm 58 form an intake chamber 60 and a discharge chamber 62 respectively. An inner portion of the cap 59 partitioned from the intake chamber 60 and the discharge chamber 62 by the pulsator diaphragm 58 form air chambers 64 communicated with an atmospheric air. Further, an intake valve 65 is provided between the intake chamber 60 and the pump chamber 54, and a discharge valve 67 is provided between the pump chamber 54 and the discharge chamber 62.

A pressure pulsation within a crank case or within an intake manifold generated in accordance with an operation of an engine, in general, a pressure pulsation within the crank case is introduced to the pulse chamber 55 from a pulse introduction port 56 provided in the cover body 53 so as to oscillate the pump diaphragm 52 in cooperation with the diaphragm spring 57. A fuel stored in a fuel tank (not shown) flows from a fuel inlet 61 to a fuel outlet 63 through the intake chamber 60, the intake valve 65, the pump chamber 54, the discharge valve 67 and the discharge chamber 62 due to an operation of the diaphragm 52 so as to be fed to a carburetor (not shown). The pulsator diaphragm 58 serves to smoothen the pulsation of the fuel in the intake chamber 60 and the discharge chamber 62 so as to improve an intake efficiency and a discharge efficiency.

The intake valve 65 and the discharge valve 67 are check valves placed on a bottom wall 51a which sections between the pump chamber 54 of the main body 51 and the intake chamber 60 and between the pump chamber 54 and the discharge chamber 62 respectively. There are provided with valve seat ports 66*a* and 68*a* communicating the intake chamber 60 with the pump chamber 54 and the pump chamber 54 with the discharge chamber 62 respectively on the bottom wall 51*a*, and are structured such that bevel-shaped valve bodies 66*b* and 68*b* made of an elastic material are mounted on the bottom wall 51*a* so as to open and close the valve seat ports 66*a* and 68*a* respectively.

On the other hand, the pulsation type diaphragm pump is generally compact, and a diameter of the pump diaphragm 52 is ordinarily less than 10 cm. Accordingly, the valve bodies 66*b* and 68*b* of the intake valve 65 and the discharge valve 67 placed within the pump are significantly small, and there is a case that the valve seat ports 66*a* and 68*a* are hardly bend and deform largely enough to open largely so that a fuel flow amount required by the engine is secured.

As the intake valve and the discharge valve, there has been known a valve with a valve body being formed in a linearly oscillating plate shape instead of a bevel shape bending and deforming at an outer peripheral edge portion. This valve body can largely open the valve seat port. However, most of such valve bodies are provided with a closing valve spring for completely closing the valve and a spring receiver for holding the closing valve spring in cooperation with the valve body, in addition to a guide for linearly oscillating the valve body. Accordingly, the number of parts constituting the pump is large and all of these parts have small sizes, so that an assembling operation thereof is troublesome and needs a lot of assembling processes and labors, thereby preventing a production cost from being reduced.

OBJECT AND SUMMARY OF THE INVENTION

An object of the present invention is to perform an opening and closing operation particularly suitable for an intake valve and a discharge valve in a pulsation type diaphragm pump provided with an intake chamber and a discharge chamber for a fuel, a pump chamber, a pump diaphragm oscillating due to a pressure pulsation generated in accordance with an operation of an engine so as to change a capacity of the pump chamber, a pulsation diaphragm smoothening a pulsation of the fuel generated in the intake chamber and the discharge chamber, an intake valve communicating or shutting the intake chamber with or from the pump chamber, and a discharge valve communicating or shutting the pump chamber with or from the discharge chamber.

Further, another object of the present invention is to reduce the number of parts constituting the intake valve and the discharge valve in the above mentioned pulsation type diaphragm pump and the number of assembling processes and labors therefor.

Further, the other object of the present invention is to make the intake valve and the discharge valve open and close normally for any engines so as to achieve a reliable pump function.

In accordance with the present invention, the intake valve is structured such that a valve seat having a valve seat port for communicating the intake chamber with the pump chamber protrudes into the inner portion of the pump chamber, and a valve body for opening and closing the valve seat port in cooperation with a seat surface of the valve seat is a portion opposing to the valve seat of the pump diaphragm. Further, the discharge valve is structured such that a valve seat having a valve seat port for communicating the pump chamber with the discharge chamber protrudes into the inner portion of the discharge chamber, and a valve body for opening and closing the valve seat port in cooperation with a seat surface of the valve seat is a portion opposing to the valve seat of the pulsator diaphragm.

The valve body of the intake valve is apart from the seat surface in an intake stroke in which the pump diaphragm is displaced in a direction to expand a capacity of the pump chamber, and is brought into contact with the seat surface and seated on the seat surface in a discharge stroke in which the pump diaphragm is displaced in a direction to compress the capacity of the pump chamber. Further, the valve body of the discharge valve is brought into contact with the seat surface in the intake stroke in which the pulsator diaphragm is displaced in a direction to compress the capacity of the discharge chamber, and is part from the seat surface in the discharge stroke in which the pulsator diaphragm is displaced in a direction to expand the capacity of the discharge chamber. As mentioned above, parts of two oscillating diaphragms serve as the valve bodies of the intake valve and the discharge valve respectively, whereby it is possible to properly intake the fuel from the intake chamber to the pump chamber and discharge the fuel from the pump chamber to the discharge chamber.

Further, since the present invention employs the pump diaphragm and the pulsator diaphragm with which the pulsation type diaphragm pump is provided as function parts in the valve body, the number of the parts constituting the intake valve and the discharge valve and the number of assembling processes and labors are reduced, whereby it is possible to achieve a reduction of a production cost.

Further, in order to improve a pump efficiency, the intake valve and the discharge valve are required to be structured such that the valve bodies thereof are completely brought into contact with the seat surface of the valve seat and seated at a time of closing the valves. Accordingly, in the intake valve, it is preferable to eccentrically arrange a diaphragm retainer of the pump diaphragm at a position not overlapping with the seat surface of the valve seat or form the pump diaphragm in a flat surface shape so as to bring it into contact with the seat surface in a flat state. Further, in any one or both of the intake valve and the discharge valve, it is preferable to form the seat surface of the valve seat with an elastic seal member or make the portion forming the valve body of the pump diaphragm and/or the pulsation diaphragm thick in such a manner as to protrude toward the seat surface, or urge a base fabric of the diaphragm to a surface opposite to the seat surface.

Next, in accordance with the present invention, at least one shim is inserted between a peripheral side wall surrounding the pump chamber of the pulsation type diaphragm pump provided with the intake valve and the discharge valve and the pump diaphragm laid over end surface thereof, and/or between both a peripheral side wall surrounding the intake chamber and the discharge chamber and a partition wall sectioning them and the pulsator diaphragm laid over end surfaces thereof.

It is possible to both largely open the valve seat port and completely attach the valve body to the seat surface by adjusting an interval between the seat surface of the intake valve and the valve body and/or an interval between the seat surface of the discharge valve and the valve body by the shim.

Further, in accordance with the present invention, the valve seat of the intake valve and/or the discharge valve is selected from structures having different protruding lengths to the pump chamber and/or the discharge chamber.

It is possible to both largely open the valve seat port and completely attach the valve body to the seat surface by adjusting an interval between the seat surface of the intake valve and the valve body and/or an interval between the seat surface of the discharge valve and the valve body by selecting the valve seat.

PARTICULAR DESCRIPTION OF THE INVENTION

Figure 1:
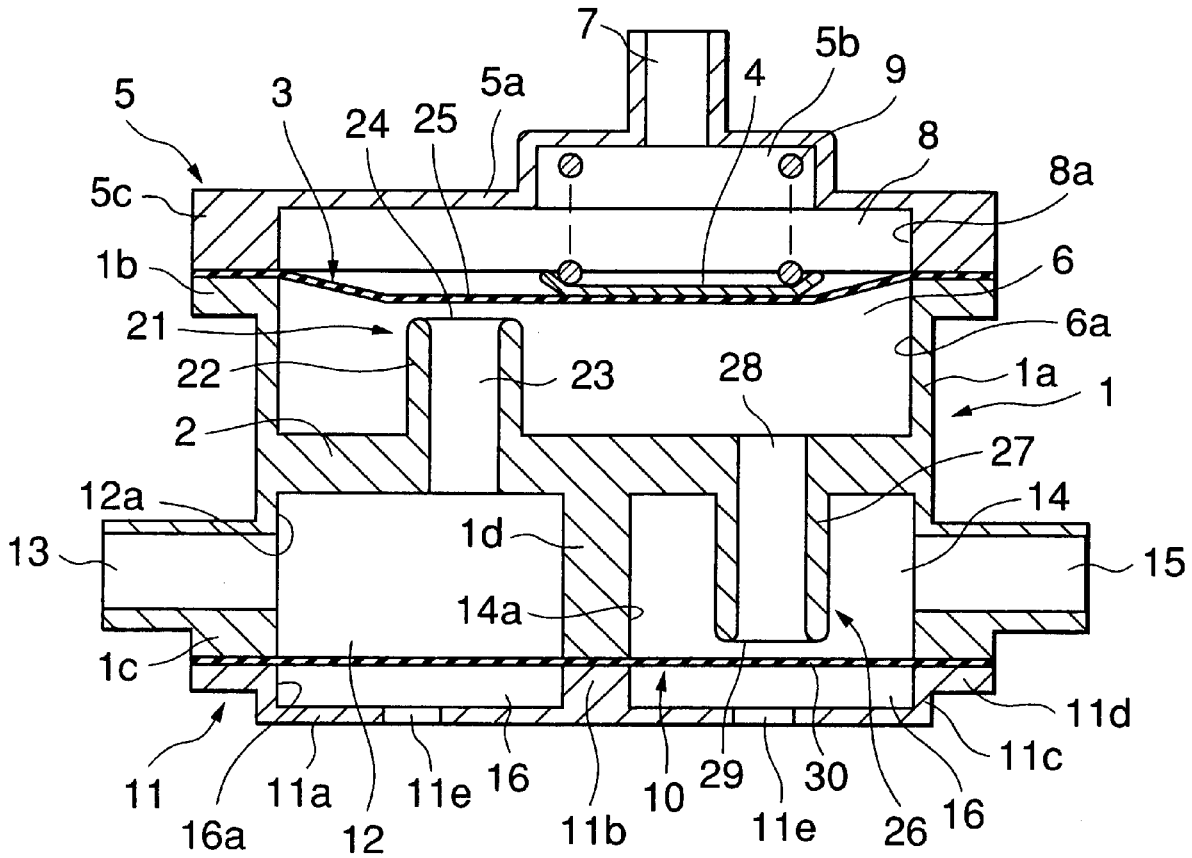
FIG. 1 is a vertical cross sectional view showing an embodiment in accordance with the present invention.
Figure 4:
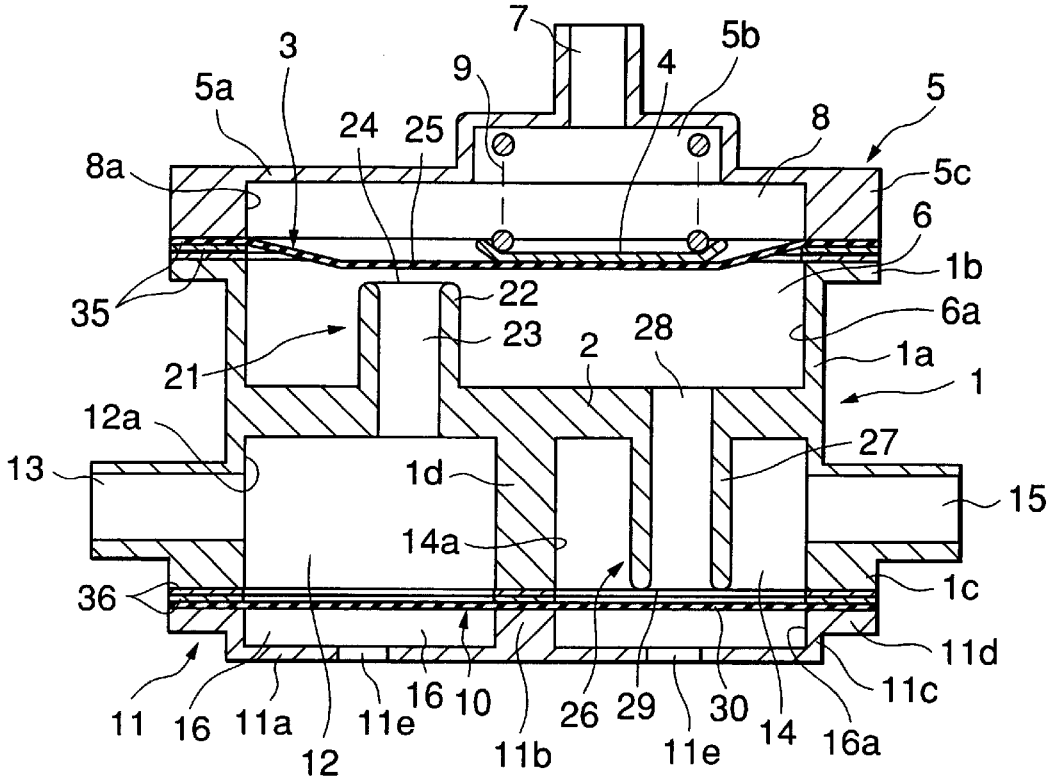
FIG. 4 is a vertical cross sectional view showing another embodiment in accordance with the present invention.
Figure 5:
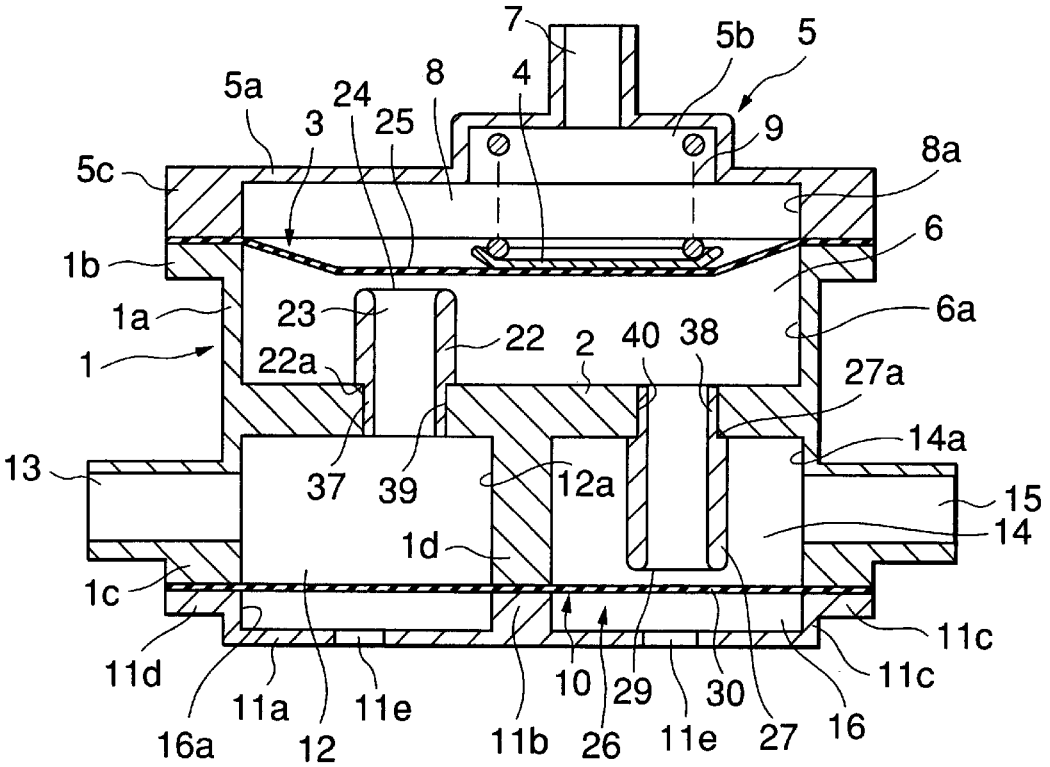
FIG. 5 is a vertical cross sectional view showing the other embodiment in accordance with the present invention.

A pulsation type diaphragm pump shown in FIGS. 1, 4 and 5 is assembled from a main body 1, a pump diaphragm 3, a cover body 5, a diaphragm spring 9, a pulsator diaphragm 10 and a cap 11. The main body 1 has a circular bottom wall 2, a cylindrical peripheral side wall 1*a* formed along an outer peripheral edge thereof, flanges 1*b* and 1*c* formed at both ends of the peripheral side wall 1*a* so as to protrude outward and a partition wall 1*d* protruding from one surface of the bottom wall 2 so as to extend in a diametrical direction thereof which are integrally formed in one. A fuel inlet 13 and a fuel outlet 15 formed in a short pipe shape are provided in a portion extending from the bottom wall 2 of the peripheral side wall 1*a* to the same side as that of the partition wall 1*d*. Further, the bottom wall 2 is provided with two cylindrical valve seats 22 and 27 protruding to an opposite direction with each other.

The cover body 5 has a circular top wall 5*a*, a circular spring receiving recess 5*b* eccentrically provided on the top wall 5*a* and a peripheral side wall 5*c* formed along an outer peripheral edge of the top wall 5*a* which are integrally formed in one. Further, a short pipe-shaped pulse introduction port 7 is provided in a portion forming the spring receiving recess 5*b* on the top wall 5*a*.

The cap 11 has a circular bottom wall 11*a*, a pressing wall 11*b* extending in a diametrical direction, a peripheral side wall 11*c* formed along an outer peripheral edge of the bottom wall 11*a* and a flange 11*d* formed on the peripheral side wall 11*c* so as to protrude outward which are integrally formed in one. Further, the bottom wall 11*a* has air holes 11*e* in two areas in both side of the pressing wall 11*b*.

An outer peripheral edge portion of the pump diaphragm 3 is laid over one flange 1*b* of the main body 1, the peripheral side wall 5*c* of the cover body 5 is laid there on and these elements are fastened to each other with a screw (not shown). A recess 6*a* surrounded by the bottom wall 2 of the main body 1 and the peripheral side wall 1*a* extending toward the pump diaphragm 3 is covered with the pump diaphragm 3 so as to form a pump chamber 6.

A recess 8*a* surrounded by the top wall 5*a* of the cover body 5 and the peripheral side wall 5*c* forms a pulse chamber 8 adjacent to the pump chamber 6 with the pump diaphragm 3 in between. The pulse introduction port 7 is connected to a crank case of the engine or the intake manifold, whereby a pressure pulsation generated there within is introduced to the pulse chamber 8.

The valve seat 22 protruding to an inner portion of the pump chamber 6 and the spring receiving recess 5*b* are arranged in both sides with the partition wall 1*d* in between and in a portion shifted from a center of the bottom wall 2. The diaphragm spring 9 is arranged between the diaphragm retainer 4 laid on the surface in the pulse chamber 6 side of the pump diaphragm 3 and the top wall 5*a*, and a part thereof is fitted to the spring receiving recess 5*b*. The diaphragm retainer 4 is placed at a position opposing to the spring receiving recess 5*b* and is laid on the pump diaphragm 3 in a shifted manner. Accordingly, a portion of the pump diaphragm 3 on which the diaphragm retainer 4 is not laid faces to the valve seat 22.

An end surface of another flange 1*c* of the main body 1 and an end surface of the partition wall 1*d* are positioned on the same plane, the outer peripheral edge portion of the pulsator diaphragm 10 and a center portion extending to a diametrical direction are laid there on, the flange 11*d* of the cap 11 and the pressing wall 11*b* are further laid there on, and these elements are fastened to each other with a screw (not shown).

Two recesses 12*a* and 14*a* surrounded by the bottom wall 2 of the main body 1, the peripheral side wall 1*a* extending toward the pulsator diaphragm 10 and the partition wall 1*d* are covered with the pulsator diaphragm 10, one of them forms an intake chamber 12 and another thereof forms a discharge chamber 14.

A recess 16*a* surrounded by the bottom wall 11*a* of the cap 11 and the peripheral side wall 11*c* is sectioned into two portions by the pressing wall 11*b*, each of them forms an air chamber 16 adjacent to the intake chamber 12 and the discharge chamber 14 respectively with the pulsator diaphragm 10 in between, and the air chambers 16 are open to the atmospheric air by the air holes 11*e*.

An end surface of the flange 11*d* of the cap 11 and an end surface of the pressing wall 11*b* are positioned on the same plane, and an end surface of the flange 1*c* of the main body 1 and an end surface of the partition wall 1*d* are formed on the same plane, whereby the pulsator diaphragm 10 is fixed so that the center portion extending in a diametrical direction is held between the partition wall 1*d* and the pressing wall 11*b*. Accordingly, the pulsator diaphragm 10 is displaced in the portion of the intake chamber 12 and the portion of the discharge chamber 14 without giving influence to each other.

The fuel inlet 13 is open to the intake chamber 12 and connected to a fuel tank (not shown) . The fuel outlet 15 is open to the discharge chamber 14 and connected to a carburetor (not shown).

The valve seat 22 protruding to the inner portion of the pump chamber 6 has a valve seat port 23 serving as a passage for communicating the intake chamber 12 with the pump chamber 6, and a front end of the valve seat 22 opposing to the pump diaphragm 3 forms a seat surface 24 having a semicircular cross sectional shape with no pointed portion. The area of the pump diaphragm 3 opposing to the seat surface 24 can be deformed without being prevented by the diaphragm retainer 4 since the diaphragm retainer 4 is not laid there on as mentioned above.

The seat surface 24 is provided at a position at which the pump diaphragm 3 oscillated and displaced due to the pressure change of the pulse chamber 8 and the spring load of the diaphragm spring 9 is brought into contact therewith during the stroke, preferably in the middle of the stroke. Accordingly, the portion of the pump diaphragm 3 opposing to the seat surface 24 serves as a valve body 25 opening and closing the valve seat port 23.

The valve seat 22, the valve seat port 23, the seat surface 24 and the valve body 25 constitute the intake valve 21.

The portion of the pump diaphragm 3 serving as the valve body 25 can freely bend and deform without being restricted by the diaphragm retainer 4. Accordingly, when the intake valve 21 performs the opening and closing operation, the valve body 25 can largely move apart from the seat surface 24 so as to secure a maximum fuel flow amount required by the engine. Further, the valve body 25 can be closely laid over the seat surface 24 so as to completely close the valve. At this time, since the seat surface 24 has no pointed portion, there is no fear that the valve body 25 is damaged.

Another valve seat 27 protrudes to an inner portion of the discharge chamber 14 in the center of the discharge chamber 14. The valve seat 27 has a valve seat port 28 serving as a passage for communicating the pump chamber 6 with the discharge chamber 14, and a front end opposing to the pulsator diaphragm 10 forms a seat surface 29 having a semicircular cross sectional shape with no pointed portion.

The seat surface 29 is provided at a position at which the seat surface 29 is brought into contact with the pulsator diaphragm 10 when the engine stops and is in a stationary state or otherwise, provided at a position at which the pulsator diaphragm 10 oscillating due to a pressure change of the pump chamber 6 and the discharge chamber 14 is brought into contact during the stroke, preferably in the middle of the stroke. Accordingly, the portion of the pulsator diaphragm 10 opposing to the seat surface 29 serves as a valve body 30 for opening and closing the valve seat port 28.

The valve seat 27, the valve seat port 28, the seat surface 29 and the valve body 30 constitute the discharge valve 26.

The pulsator diaphragm 10 having the portion serving as the valve body 30 at the center thereof oscillates dependently upon only a difference of force applied to both surfaces thereof, and, in particular, is freely bent and deformed since no portion preventing a flexibility of the diaphragm is provided in the center portion thereof, so that the valve body 30 largely moves from the seat surface 29 or is closely attached to the seat surface 29 to be laid over it. Accordingly, it is possible to secure a maximum fuel flow amount required by the engine and completely close the valve.

In the case that the pulse chamber 8 is connected to the crank case of the engine, the pump diaphragm 3 is displaced toward the pulse chamber 8 due to a negative pressure generated within the crank case in the stroke that the piston of the engine moves toward a top dead center so as to generate the negative pressure in the pump chamber 6. The valve body 25 moves apart from the seat surface 24 in accordance with the displacement mentioned above of the pump diaphragm 3, thereby making the intake valve 21 in an open valve state. Accordingly, the fuel fed to the intake chamber 12 from the fuel tank (not shown) flows into the pump chamber 6 through the valve seat port 23. On the other hand, the pulsator diaphragm 10 is sucked by the negative pressure of the pump chamber 6 so as to be displaced, and the valve body 30 thereof is closely attached to the seat surface 29 so as to make the discharge valve 26 in a valve close state.

The pump diaphragm 3 is displaced toward the pump chamber 6 due to a spring force of the diaphragm spring 9 and a positive pressure generated within the crank case in the stroke in which the piston of the engine moves toward a bottom dead center, thereby pressurizing the fuel in the pump chamber 6 so as to make a positive pressure. The valve body 25 is closely attached to the seat surface 24 in accordance with the displacement mentioned above of the pump diaphragm 3 so as to make the intake valve 21 in a valve close state. On the other hand, the fuel pressure in the pump chamber 6 and the valve seat port 28 is applied to the valve body 30 so as to displace the pulsator diaphragm 10 toward the air chamber 16, and the valve body 30 is apart from the seat surface 29 so as to make the discharge valve 26 in a valve open state. Accordingly, the fuel in the pump chamber 6 flows into the discharge chamber 14 from the valve seat port 28, and is fed to the carburetor (not shown) from the fuel outlet 15.

In accordance with the repeated operations mentioned above, the fuel in the fuel tank is fed to the carburetor through the intake chamber 12, the pump chamber 6 and the discharge chamber 14. At this time, since the valve bodies 25 and 30 of the intake valve 21 and the discharge valve 26 are formed by the pump diaphragm 3 and the pulsator diaphragm 10 served as the function parts of the pump, it is possible to increase the maximum fuel flow amount in accordance with the stroke of these two diaphragms 3 and 10, in particular, the portions of the valve bodies 25 and 30, and an attitude of each of the diaphragms 3 and 10 when the valve bodies 25 and 30 are brought into contact with the seat surfaces 24 and 29.

Figure 2:
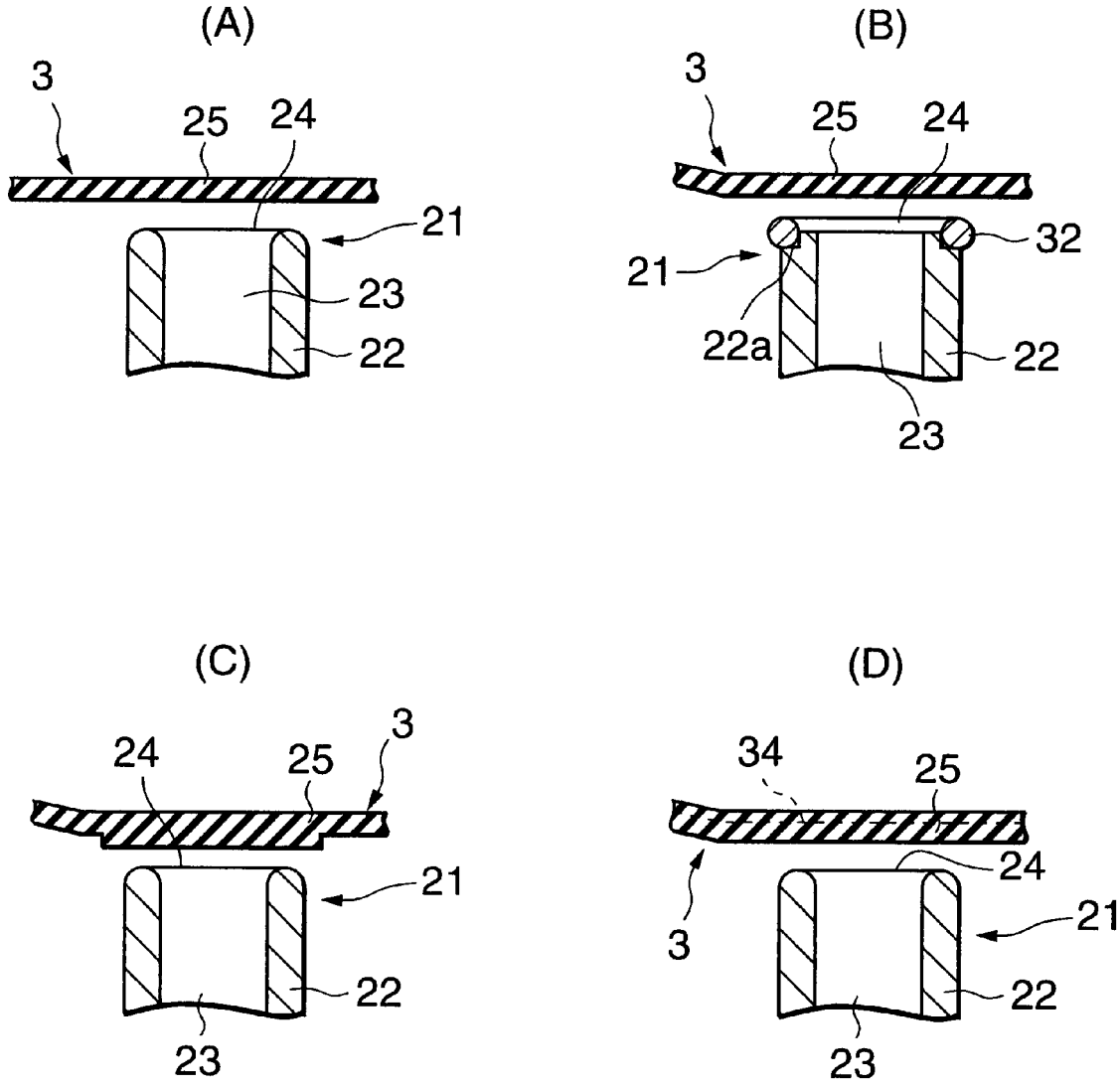
FIGS. 2(A), 2(B), 2(C) and 2(D) are partial vertical cross sectional views showing modified embodiments of the embodiment shown in FIG. 1.

The intake valve 21 and the discharge valve 26 mentioned above are a check valve serving so as to prevent the fuel from flowing in an opposite direction, and accordingly, it is required to completely close the valve in addition to securing the required fuel flow amount of the engine. FIG. 2 shows some particular embodiments preferable for achieving the object of completely closing the valve.

FIG. 2(A) shows a structure for completely closing the intake valve 21. The pump diaphragm 3 is formed in a flat shape so that the outer peripheral edge portion and the oscillating effective diameter portion which are held between the main body 1 and the cover body 5 are positioned on one plane in a stationary state during the engine stops, and the structure is made such that the valve body 25 is brought into contact with the seat surface 24 in this flat shape. Forming to be in a flat shape in a stationary state is the same as that of the pulsation diaphragm 10. The valve body 25 is closely attached to the seat surface 24 at the discharge stroke time so as to completely close the intake valve 21.

FIG. 2(B) shows a structure in which a step portion 22*a* is provided at a front end outer peripheral edge of the valve seat 22 in the intake valve 21, a seal member 32 constituted of an O-ring is attached thereto, and the seat surface 24 with which the valve body 25 is brought into contact is formed by the elastic seal member 32. The valve body 25 which is a part of the pump diaphragm 3 is elastically brought into contact with the seal member 32 and closely attached thereto so as to make a complete valve closing state. The seal member 32 can be placed in the valve seat 27 of the discharge valve 26, and accordingly this particular embodiment can be applied to both of the intake valve 21 and the discharge valve 26.

FIG. 2(C) shows a structure in which in the portion opposing to the seat surface 24 of the valve seat 22 in the intake valve 21, a thick portion protruding toward the seat surface 24 is formed in the pump diaphragm 3 and this thick portion is set to the valve body 25. An elastic force of a rubber which is a material of the pump diaphragm 3 has a large value in the thick portion, and is closely attached to the seat surface 24 in a strong manner so as to make a complete valve close state. This thick portion can be also formed in the pulsator diaphragm 10, and accordingly, this particular embodiment can be applied to both of the intake valve 21 and the discharge valve 26.

FIG. 2(D) shows a structure in which a reinforcing base fabric 34 inserted into the pump diaphragm 3 is inserted so as to be offset to an opposite surface side to the seat surface 24. Accordingly, it is possible to reduce the problem that the elastic force of the rubber used as the material of the pump diaphragm 3 is prevented by the base fabric 34, and the valve body 25 is well closely attached to the seat surface 24 so as to make a complete valve close state. With respect to the pulsator diaphragm 10, the structure can also be made such that the base fabric is inserted so as to be offset to the opposite surface to the seat surface 29 of the discharge valve 26, and accordingly, this particular embodiment can be applied to both of the intake valve 21 and the discharge valve 26.

In this case, it is possible to apply to the intake valve 21 and the discharge valve 26 different structures selected among the particular embodiments shown in FIGS. 2(B), 2(C) and 2(D). For example, it is possible to apply the particular embodiment shown in FIG. 2(A) to the intake valve 21 and apply any one of the particular embodiments shown in FIGS. 2(B), 2(C) and 2(D) to the discharge valve 26.

Figure 3:
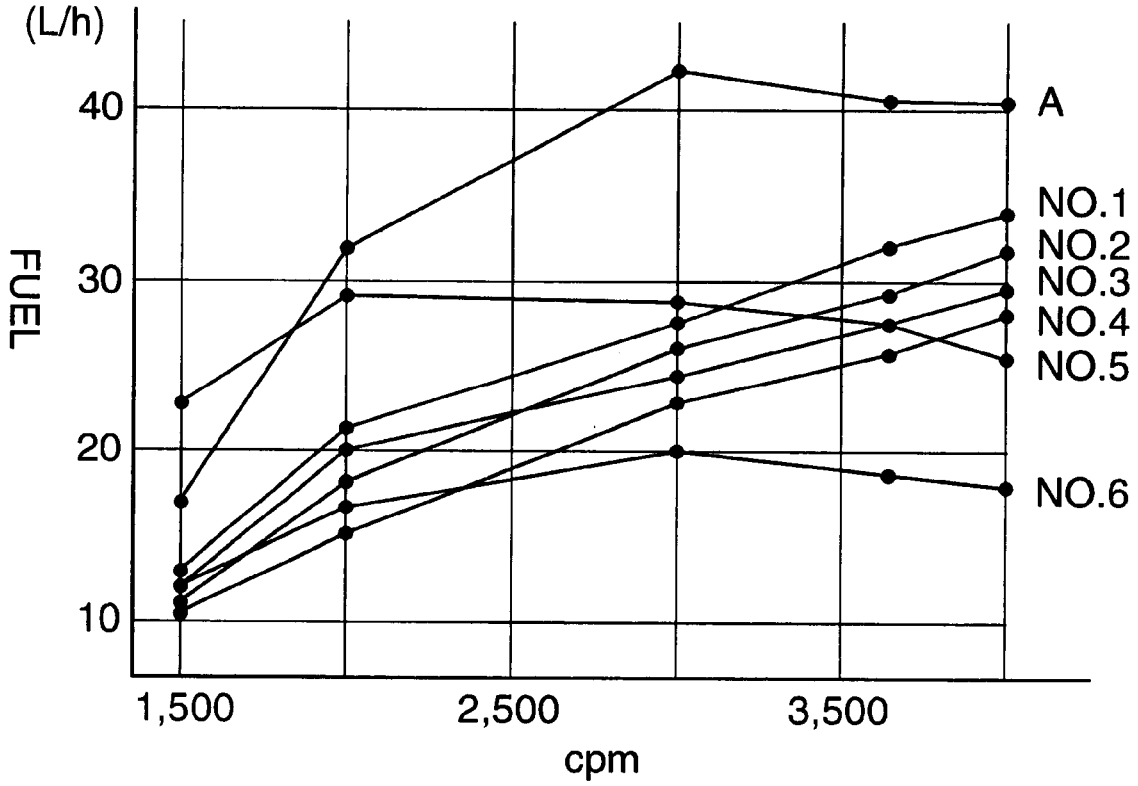
FIG. 3 is a graph showing a performance test result of the product in accordance with the present invention shown in FIG. 1 and the product in accordance with the conventional art.

FIG. 3 is a graph showing results of a comparing test of a fuel flow amount between six pulsation type diaphragm pumps selected from those having the same capacity which are produced and sold in a plurality of countries and the pump having the structure of the particular embodiment shown in FIG. 1 and having the same capacity. A horizontal axis in the graph corresponds to an intake negative pressure expressing an operating state of the engine and a vertical axis corresponds to a fuel flow amount. It is understandable from the graph that the fuel flow amount of the product in accordance with the present invention shown by No. A is greater than No. 1, No. 2, No. 3, No. 4, No. 5 and No. 6 showing the conventional product.

Next, in the engine in which the fuel is supplied by the pulsation type diaphragm pump mentioned above, it is a well known fact that a pressure value of a pressure pulsation generated within the crank case or the intake manifold is different depending on the difference of two cycle and four cycle, and the number of the cylinders. Accordingly, in the case of the pump produced by setting various sizes so as to achieve a proper pump function with respect to a certain engine being used in another engine, an amount of oscillation of the pump diaphragm 3 and the pulsator diaphragm 10 becomes different. As a result, there is generated a problem that any one or both of the intake valve 21 and the discharge valve 26 are insufficiently opened and closed, and the amount required by the engine can not be fed.

This problem can be solved by producing multiple kinds of pumps in accordance with the kinds of the engines and the number of the cylinders. However, in order to avoid disadvantages in view of production, management and cost generated therefor, in accordance with the present invention, the structure is made such that the intake valve 21 and the discharge valve 26 can perform a proper opening and closing operation so as to feed the fuel at the amount required by the engine by significantly simple means that the main body 1, the pump diaphragm 3, the cover body 6, the pulsator diaphragm 10 and the cap 11 are used commonly with modification of sizes of certain portions, even when the kind of the engine and the number of the cylinders are different.

FIG. 4 is a vertical cross sectional view showing a particular embodiment thereof. In this embodiment, two shims 35 are inserted between one flange 1*b* of the main body land the pump diaphragm 3. Further, two shims 36 are inserted between both another flange 1*c* of the main body 1 and the partition wall 1*d* and the pulsator diaphragm 10.

As is well-known, the shim is a thin plate member inserted between two elements for adjusting an interval between them. The shim 35 laid on the end surface of the flange 1*b* is a thin ring having substantially the same width as a width of the flange 1*b*, and changes a position of the valve body 25 opposing to the seat surface 24 of the intake valve 21 so as to adjust the interval between them. The shim 36 laid on the end surface of the flange 1*c* and the partition wall 1*d* is constituted by a thin ring portion having substantially the same width as a width of the flange 1*c* and a center portion having substantially the same width as a width of the partition wall 1*d* and extending in a diametrical direction of the ring portion, and changes a position of the valve body 30 opposing to the seat surface 29 of the discharge valve 26-so as to adjust the interval between them.

In the case of producing the pump by combining the shims 35, the pump diaphragm 3, the diaphragm spring 9, the cover body 5, the shims 36, the pulsator diaphragm 10 and the cap 11 with the main body 1 mentioned above, the pump is produced by setting various sizes so that the intake valve 21 and the discharge valve 26 perform a proper opening and closing operation in accordance with the pressure pulsation having an average amplitude at a time of inserting several, for example, three shims 35 and 36 there. For use of the engine having the different kinds and the different number of the cylinders, in the case that the amplitude of the pressure pulsation generated by the engine is greater than the average amplitude, the number of either or both of the shims 35 in the pump diaphragm 3 side and the shims 36 in the pulsator diaphragm 10 side is increased. On the contrary, in the case that the amplitude of the pressure pulsation is smaller than the average amplitude mentioned above, either or both of the shims 35 in the pump diaphragm 3 side and the shims 36 in the pulsator diaphragm 10 side is taken out to reduce the number of the shims to be inserted.

In accordance with the present invention, it is possible to apply the structure to various engines by preparing the pump in which various sizes are set so that the intake valve 21 and the discharge valve 26 performs a proper opening and closing operation in accordance with the pressure pulsation having the minimum amplitude at which the pump can operate without the shims 35 and 36 being inserted, and inserting the shims 35 and 36 in the number corresponding to the magnitude of the amplitude of the pressure pulsation generated by the used engine to either or both of the pump diaphragm 3 side and the pulsator diaphragm 10 side. Otherwise, it is possible to apply the structure to various engines by preparing the pump in which various sizes are set so that the intake valve 21 and the discharge valve 26 performs a proper opening and closing operation in accordance with the pressure pulsation having the maximum amplitude at which the engine can generate with a lot of shims 35 and 36 being inserted, and taking out the shims 35 and 36 in the number corresponding to the magnitude of the amplitude of the pressure pulsation generated by the used engine from either or both of the pump diaphragm 3 side and the pulsator diaphragm 10 side.

As mentioned above, by significantly simple means that a base pump is prepared and the shims 35 and 36 are inserted or taken out depending on the engine, it is possible to change the positions of the valve bodies 25 and 30 with respect to the seat surfaces 25 and 29 without applying any change to the parts constituting the pump so as to properly perform the opening and closing operation of the intake valve 21 and the discharge valve 26.

In this case, multiple sheets of the shims 35 and 36 having the same thickness are prepared so as to apply to the engine by increasing and reducing the use number, however, it is possible to prepare the multiple sheets of shims having different thicknesses and select one having a desired thickness among them.

FIG. 4 shows a pump structured such that the shims 35 and 36 are laid on both of the flanges 1*b* and 1*c* of the main body 1 so as to adjust both of the interval between the seat surface 24 of the intake valve 21 and the valve body 25 and the interval between the seat surface 29 of the discharge valve 26 and the valve body 30. However, it is undeniable that there is a case that only any one of the intake valve 21 and the discharge valve 26 is adjusted depending on the property of the engine. In this case, the shims 35 and 36 are used for any one of the pump diaphragm 3 or the pulsator diaphragm 10.

FIG. 5 is a vertical cross sectional view showing another particular embodiment. While the pump shown in FIG. 4 is structured such as to change the positions of the valve bodies 25 and 30 to the seat surfaces 24 and 29 of the intake valve 21 and/or the discharge valve 26, the pump shown in FIG. 5 is structured such as to change the positions of the seat surfaces 24 and 29 to the valve bodies 25 and 30 of the intake valve 21 and/or the discharge valve 26.

The pumps shown in FIGS. 1 and 4 are structured such that the valve seats 22 and 27 of the intake valve 21 and the discharge valve 26 are integrally formed with the bottom wall 2 of the main body 1. However, the pump shown in FIG. 5 is structured such that the valve seats 22 and 27 are formed as an independent body from the bottom wall 2.

These valve seats 22 and 27 are integrally provided with cylindrical leg pieces 37 and 38 having outer diameters smaller than outer diameters of the valve seats 22 and 27 in such a manner as to protrude from base end surfaces 22*a* and 27*a*, and the leg pieces 37 and 38 are inserted into mounting holes 39 and 40 provided on the bottom wall 2. The leg pieces 37 and 38 are inserted into the mounting holes 39 and 40 until the base end surfaces 22*a* and 27*a* are brought into contact with the surface of the bottom wall 2, and are fixed in a liquid tight manner by means of welding, if necessary, or an adhesive agent so as to close the gap between them.

Figure 6:
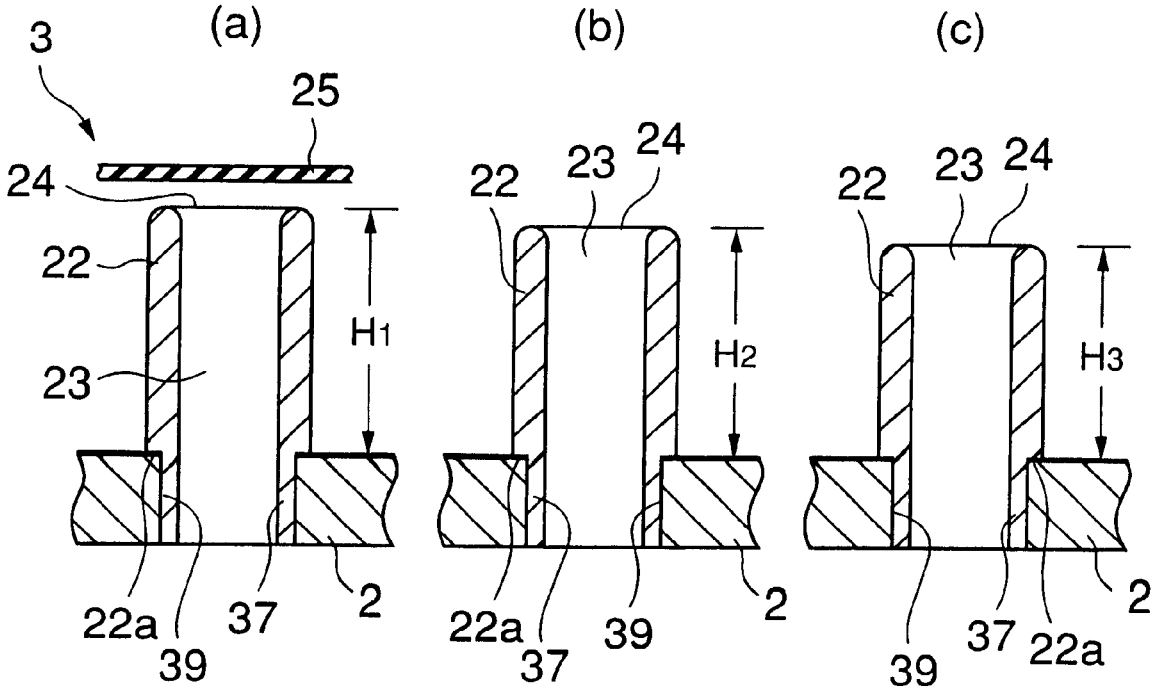
FIG. 6*a–c* is a partial vertical cross sectional view showing a modified embodiment of a valve seat in the embodiment shown in FIG. 5.
Figure 7:
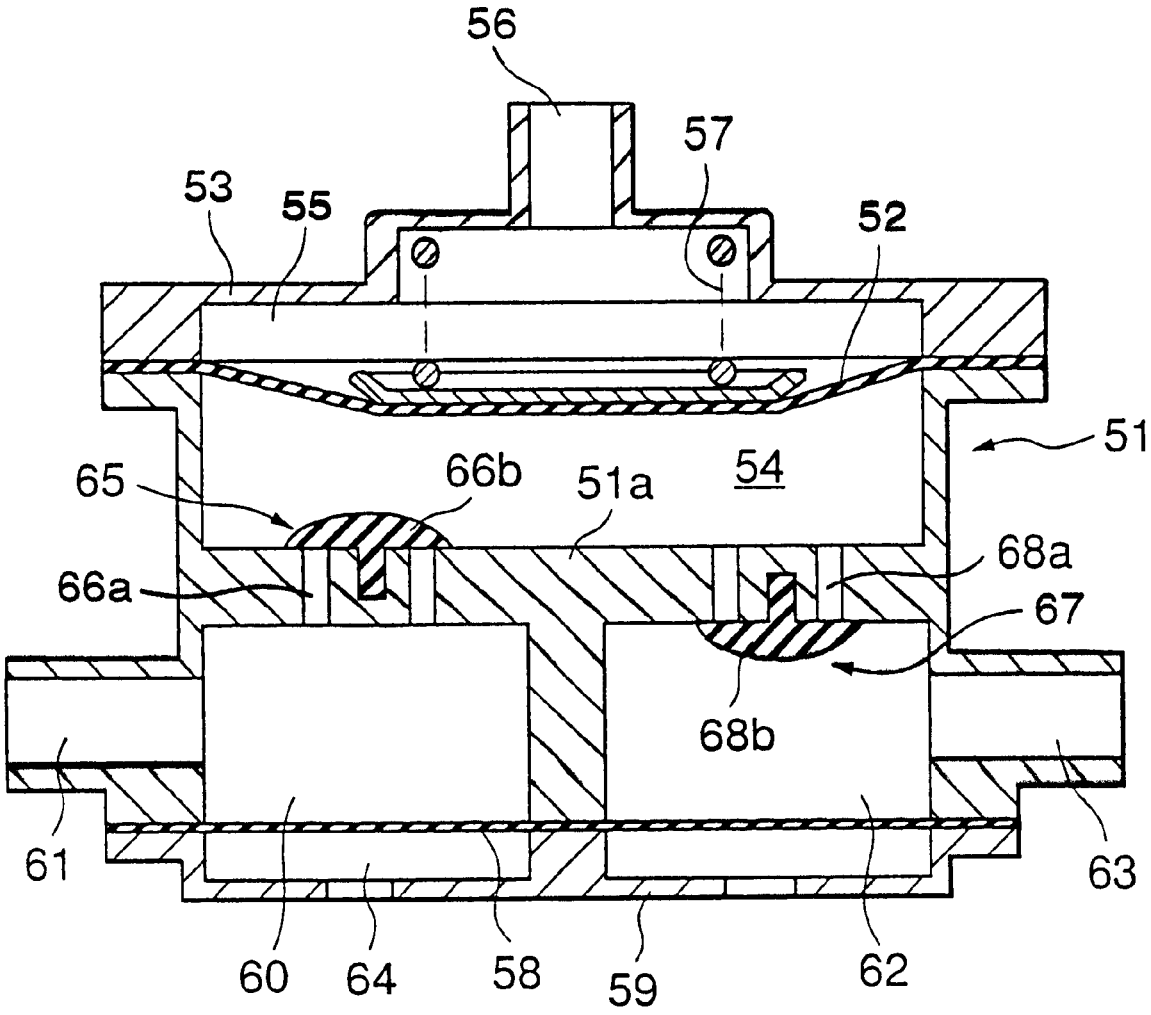
Fig. 7 (Prior Art)
FIG. 7 is a vertical cross sectional view showing an embodiment in accordance with the conventional art.

With reference to FIGS. 6(A), 6(B) and 6(C), there are prepared a multiplicity of valve seats 22 of the intake valve 21 in which lengths between the base end surface 22*a* and the seat surface 24, that is, protruding lengths H1, H2 and H3 to the pump chamber 6 at a time of bringing the base end surface 22*a* into contact with the surface of the bottom wall 2 are different. These leg pieces 37 are formed so as to have a length equal to the thickness of the bottom wall 2. The valve seat 22 having a length for making the interval with respect to the seat surface 24 proper is selected to the valve body 25 of the pump diaphragm 3 which operates in accordance with an oscillating amount being different depending on the kind of the engine and the number of the cylinders, and is mounted to the bottom wall 2.

With respect to the valve seat 27 of the discharge valve 26, a multiplicity of valve seats 27 having different lengths between the base end surface 27*a* and the seat surface 29 are prepared, and a proper one among them is selected and is mounted to the bottom wall 2.

The pump shown in FIG. 5 is structured such that the both valve seats 22 and 26 of the intake valve 21 and the discharge valve 26 are independently prepared from the bottom wall 2 so as to adjust the respective intervals between the seat surfaces 25 and 29 of the intake valve 21 and the discharge valve 26 and the valve bodies 25 and 30. However, there is a case that only one of them is to be adjusted depending on the characteristic of the engine, and in this case, the valve seats 22 or 26 requiring no adjustment can be integrally formed with the bottom wall 2.

What is claimed is:

1. An pulsation type diaphragm pump comprising:

an intake chamber connected to a fuel tank;

a pump chamber;

a discharge chamber connected to a carburetor;

a pump diaphragm oscillating due to a pressure pulsation generated in accordance with an operation of an engine so as to change a volume of said pump chamber;

a pulsator diaphragm smoothening a fuel pulsation generated in said intake chamber and said discharge chamber;

an intake valve allowing only a flow of fuel flowing from said intake chamber to the pump chamber; and a discharge valve allowing only a flow of fuel flowing from said pump chamber to the discharge chamber, wherein said intake valve is provided with a valve seat having a valve seat port communicating said intake chamber with the pump chamber and protruded to an inner portion of said pump chamber, and a valve body constituted of a portion opposing to said valve seat of said pump diaphragm, and is structured such that said valve body is brought into contact with a seat surface at a front end of said valve seat in accordance with an oscillation of said pump diaphragm or moves apart therefrom so as to open and close said valve seat port, and wherein said discharge valve is provided with a valve seat having a valve seat port communicating said pump chamber with the discharge chamber and protruded to an inner portion of said discharge chamber, and a valve body constituted of a portion opposing to said valve seat of said pulsator diaphragm, and is structured such that said valve body is brought into contact with a seat surface at a front end of said valve seat in correspondence to an oscillation of said pulsator diaphragm or moves apart therefrom so as to open and close said valve seat port.

2. A pulsation type diaphragm pump as claimed in claim 1, wherein the valve seat of said intake valve extends from a bottom wall commonly used for said intake chamber and the pump chamber and protrudes into an inner portion of said pump chamber at a portion shifted from a center, and the valve seat of said discharge valve extends from the bottom wall commonly used for said pump chamber and the discharge chamber and protrudes into an inner portion of said discharge chamber at a center portion.

3. A pulsation type diaphragm pump as claimed in claim 1, wherein a diaphragm retainer of said pump diaphragm is eccentrically arranged at a position which does not overlap with the seat surface of said intake valve, and a portion of said pump diaphragm with which said diaphragm retainer is not overlapped is set to a valve body of said intake valve.

4. A pulsation type diaphragm pump as claimed in claim 1, wherein said pump diaphragm is formed in a flat shape positioned on one plane in a stationary state during an engine stop so as to be brought into contact with the seat surface of said intake valve in said flat shape.

5. A pulsation type diaphragm pump as claimed in claim 1, wherein said seat surface of said intake valve and/or the discharge valve is formed of a seal member having an elasticity.

6. A pulsation type diaphragm pump as claimed in claim 1, wherein a portion of said pump diaphragm and/or the pulsator diaphragm opposing to said seat surface is formed in a thick shape protruding toward said seat surface, and said thick portion is set to the valve body of said intake valve and/or the discharge valve.

7. A pulsation type diaphragm pump as claimed in claim 1, wherein a base fabric inserted to said pump diaphragm and/or the pulsator diaphragm for reinforcing is inserted so as to be offset to a surface opposite to said seat surface.

8. An pulsation type diaphragm pump comprising:

an intake chamber connected to a fuel tank;

a pump chamber;

a discharge chamber connected to a carburetor;

a pump diaphragm oscillating due to a pressure pulsation generated in accordance with an operation of an engine so as to change a volume of said pump chamber;

a pulsator diaphragm smoothening a fuel pulsation generated in said intake chamber and said discharge chamber;

an intake valve allowing only a flow of fuel flowing from said intake chamber to the pump chamber;

a discharge valve allowing only a flow of fuel flowing from said pump chamber to the discharge chamber;

one recess surrounded by a bottom wall of a main body and a peripheral side wall thereof, said one recess forming said pump chamber;

two recesses surrounded by said bottom wall, a peripheral side wall extending to an opposite side of said pump chamber and a partition wall, said two recesses forming said intake chamber and the discharge chamber, wherein said intake valve is provided with a valve seat having a valve seat port communicating said intake chamber with the pump chamber and protruded to an inner portion of said pump chamber, and a valve body constituted of a portion opposing to said valve seat of said pump diaphragm, and said discharge valve is provided with a valve seat having a valve seat port communicating said pump chamber with the discharge chamber and protruded to an inner portion of said discharge chamber, and a valve body constituted of a portion opposing to said valve seat of said pulsator diaphragm, and wherein at least one shim is inserted between an end surface of said peripheral side wall surrounding said pump chamber and said pump diaphragm laid there on, and/or between both an end surface of said peripheral side wall surrounding said intake chamber and the discharge chamber and an end surface of said partition wall and said pulsator diaphragm laid there on, and the seat surface of said valve seat of said intake valve and/or the discharge valve and said valve body are faced to each other at an interval adjusted by said shim.

9. A pulsation type diaphragm pump as claimed in claim 8, wherein the shim inserted between the end surface of said peripheral side wall and said pump diaphragm is a thin ring disposed along said end surface.

10. A pulsation type diaphragm pump as claimed in claim 8, wherein the shim inserted between both the end surface of said peripheral side wall and the end surface of the partition wall and said pulsator diaphragm is constituted of a thin ring portion disposed along the end surface of said peripheral side wall and a thin center portion extending in a diametrical direction of said ring portion along the end surface of said partition wall.

11. A pulsation type diaphragm pump as claimed in claim 8, wherein said shims are formed so as to have a uniform thickness and one or plural sheets of said shims are inserted between said end surface and the diaphragm.

12. A pulsation type diaphragm pump as claimed in claim 8, wherein said shim is structured such that one sheet selected among shims having different thicknesses is inserted between said end surface and the diaphragm.

13. An pulsation type diaphragm pump comprising:

an intake chamber connected to a fuel tank;

a pump chamber;

a discharge chamber connected to a carburetor;

a pump diaphragm oscillating due to a pressure pulsation generated in accordance with an operation of an engine so as to change a volume of said pump chamber;

a pulsator diaphragm smoothening a fuel pulsation generated in said intake chamber and said discharge chamber;

an intake valve allowing only a flow of fuel flowing from said intake chamber to the pump chamber;

a discharge valve allowing only a flow of fuel flowing from said pump chamber to the discharge chamber;

said pump chamber being provided in one side with respect to a bottom wall of a main body; and said intake chamber and said discharge chamber being provided in another side, wherein said intake valve is provided with a cylindrical valve seat having a valve seat port communicating said intake chamber with the pump chamber and protruded to an inner portion of said pump chamber from said bottom wall, and a valve body constituted of a portion opposing to said valve seat of said pump diaphragm, and said discharge valve is provided with a cylindrical valve seat having a valve seat port communicating said pump chamber with the discharge chamber and protruded to an inner portion of said discharge chamber from said bottom wall, and a valve body constituted of a portion opposing to said valve seat of said pulsator diaphragm, and wherein the valve seat of said intake valve and/or the valve seat of said discharge valve is independently formed from said bottom wall.

14. A pulsation type diaphragm pump as claimed in claim 13, wherein the valve seat of said intake valve and/or the valve seat of the discharge valve is formed as an independent body from said bottom wall, and one of the valve seats having different lengths is mounted to said bottom wall, whereby a seat surface thereof faces to said valve body with an adjusted interval.

* * * * *